United States Patent [19]

Arnold et al.

[11] Patent Number: 4,612,748

[45] Date of Patent: Sep. 23, 1986

[54] POLYMER CONCRETE BLOCK

[76] Inventors: Ronald G. Arnold, 43842 12½ Mile Rd., Novi, Mich. 48050; Edmund J. Matras, 7342 Oakman Blvd., Dearborn, Mich. 48126

[21] Appl. No.: 690,892

[22] Filed: Jan. 14, 1985

[51] Int. Cl.[4] ..... E04C 1/00; E04B 5/10

[52] U.S. Cl. ..... 52/309.16; 52/600; 428/188

[58] Field of Search ..... 52/576, 577, 309.1, 52/309.16, 309.7, 223 R, 600; 428/188, 316.5, 36

[56] References Cited

U.S. PATENT DOCUMENTS

| | | | |
|---|---|---|---|
| 1,477,520 | 12/1923 | Pittman | 52/576 |
| 1,761,848 | 6/1930 | Sitzman et al. | 52/587 |
| 2,198,885 | 3/1940 | Price | 428/316.5 |
| 2,924,962 | 2/1960 | Nettle | 52/577 |
| 3,239,982 | 3/1966 | Nicosia | 52/309.7 |
| 4,335,177 | 6/1982 | Takeuchi | 428/188 |
| 4,375,489 | 3/1983 | Muszynski | 428/36 |

FOREIGN PATENT DOCUMENTS

| | | | |
|---|---|---|---|
| 257347 | 2/1961 | Australia | 52/223 R |
| 522510 | 11/1928 | Fed. Rep. of Germany | 52/223 R |

*Primary Examiner*—James L. Ridgill, Jr.
*Attorney, Agent, or Firm*—Krass & Young

[57] ABSTRACT

A building block comprising a monolithic matrix of polymer concrete with a row of rectangular steel tubes embedded in the polymer matrix and totally filled by the polymer matrix, and woven fiberglass sheets embedded in the polymer matrix between the upper surfaces of the tubes and the upper surface of the matrix and between the lower surfaces of the tubes and the lower surface of the matrix.

9 Claims, 3 Drawing Figures

Fig-1
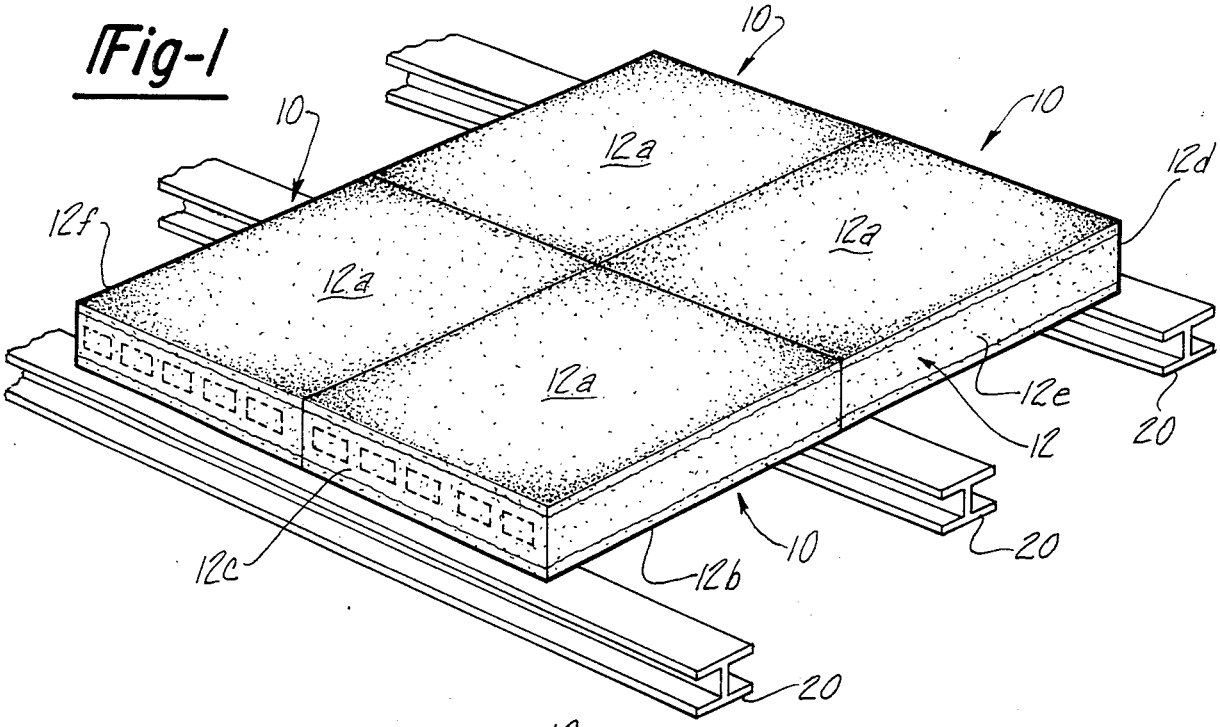
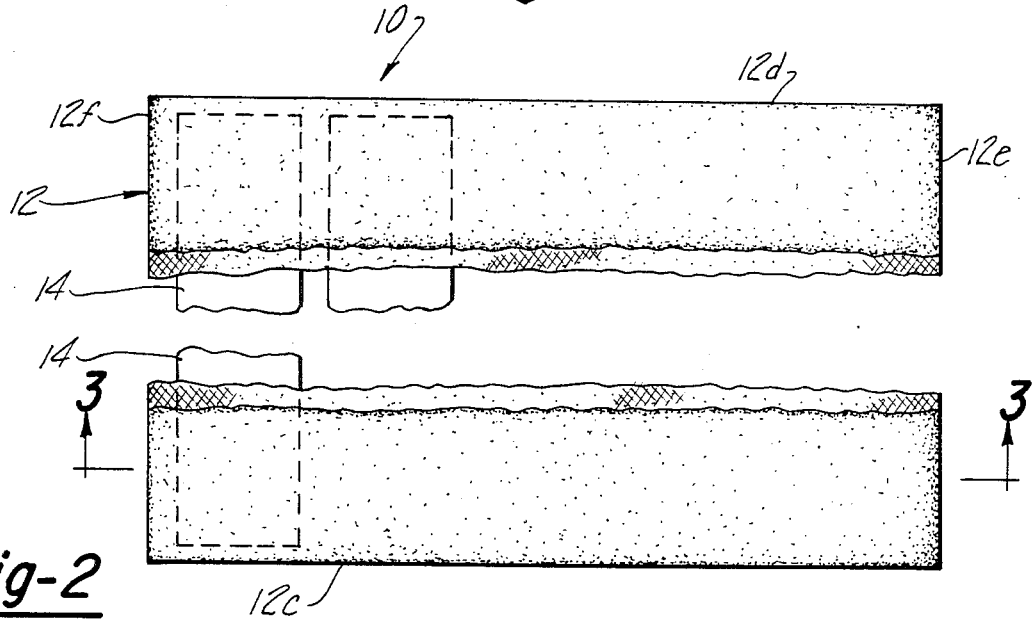
Fig-2
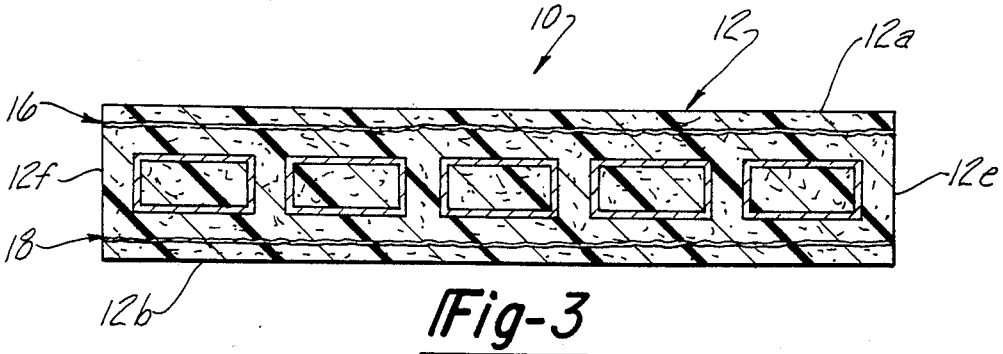
Fig-3

POLYMER CONCRETE BLOCK

BACKGROUND OF THE INVENTION

This invention relates to polymer concrete blocks and, more particularly, to a polymer concrete block especially suited for use as a unsupported floor slab.

Blocks and slabs formed of concrete or concrete derivatives have been in use for centuries in various building applications. Concrete and its derivatives have traditionally suffered, however, from tendencies to crack and crumble and their ability to span large gaps in the associated support structure has been severly limited. In an effort to overcome some of the shortcomings of concrete blocks, blocks formed of various polymer concretes have been developed and utilized with considerable success. Specifically, the polymer concrete blocks have exhibited superior wear characteristics as compared to similar concrete blocks and have proven to be much more resistant to crumbling and cracking than comparable concrete blocks. Polymer concrete blocks however continue to be limited in their ability to span significant gaps in the underlying support structure and are thus unsuitable for unsupported applications such, for example, as to provide a cover for the pit surrounding large stamping presses to allow access to the press at intermediate locations on the height of the press.

SUMMARY OF THE INVENTION

This invention is directed to the provision of a polymer concrete block that is especially suited for use as an unsupported floor slab.

The polymer concrete block according to the invention comprises a monolithic, rectangular parallelipipid matrix formed of polymer concrete; a row of steel tubes embedded in the polymer matrix with polymer concrete totally filling the tubes; a first sheet of fabric embedded in the polymer matrix between the upper surfaces of the tubes and the upper surface of the polymer matrix; and a second sheet of fabric embedded in the polymer matrix between the lower surface of the tubes and the lower surface of the matrix. This construction retains all of the superior wear and crumble resistant characteristics of a polymer concrete block while adding significantly to the bending strength of the block and thereby the ability of the block to span large gaps in the associated underlying support structure. The embedded sheets of fabric are substantially totally impregnated by the resin of the concrete polymer in the final block and thus function to tie the entire block together and impede crumbling or cracking of the block particularly along its upper and lower surfaces.

According to a further aspect of the invention the tubes have a rectangular cross section and are arranged side by side in the polymer matrix with their upper and lower surfaces lying in common planes respectively parallel to the upper and lower surfaces of the matrix.

According to a further aspect of the invention, the tubes have a width greater than their thickness and are arranged with their widths extending parallel to the upper and lower surfaces of the matrix.

According to a further aspect of the invention, the sum of the widths of the tubes is more than half of the width of the matrix, and the tubes have a thickness less than one half but more than one third the thickness of the matrix.

In the disclosed embodiment of the invention, the sheets of fabric comprise sheets of woven fiberglass respectively disposed substantially midway between the upper and lower surfaces of the tubes and the upper and lower surfaces of the polymer matrix.

BRIEF DESCRIPTION OF THE DRAWINGS

FIG. 1 is a fragmentary perspective view of a plurality of invention polymer concrete block laid on spaced structural beams to provide a flooring;

FIG. 2 is a top fragmentary view of a polymer concrete block according to the invention; and FIG. 3 is a cross sectional view taken on line 3—3 of FIG. 2.

DETAILED DESCRIPTION OF THE PREFERRED EMBODIMENT

The invention polymer concrete block, seen generally at 10, comprises a matrix 12; a plurality of steel tubes 14; and first and second sheets of fabric 16 and 18.

Matrix 12 comprises a monolithic, rectangular parallelipipid formed of polymer concrete and having parallel flat upper and lower surfaces 12*a* and 12*b*; end edge surfaces 12*c* and 12*d*, and side edge surfaces 12*e* and 12*f*. The polymer concrete forming matrix 12 comprises a polymer resin, sand, aggregate, pigments, and a suitable catalyst. For example, the polymer resin may comprise a polyester resin available from Reichhold Chemicals, Inc. of White Plains, New York as Polyrite® Resin 92-871. Matrix 12 may have various dimensions depending upon the particular application. For example, matrix 12 may have a width between 24 and 31 inches, a length between 30 and 48 inches, and a thickness $3\frac{3}{4}$ inches.

Tubes 14 comprise steel tubing having a length slighly less than the length of matrix 12. In a typical application, tubes 14 may comprise 14 gage steel tubing having a thickness of $1\frac{1}{2}$ inches and a width of $3\frac{1}{2}$ inches.

Fabric sheets 16 and 18 have a width and length substantially conforming to the width and length of matrix 12 and preferably comprise sheets of six ounce woven fiberglass cloth.

In the manufacture of the invention polymer concrete block, a batch of suitable polymer concrete is prepared; a small quantity of the polymer concrete is poured into a suitable female mold (not shown); the fiberglass sheet 18 is laid over the poured polymer concrete; a further amount of polymer concrete is poured over sheet 18; tubes 14 are laid on top of the poured polymer concrete in a uniformly spaced row extending across the width of the block; further polymer concrete is poured over and into the tubes 14 to cover and fill the tubes and form a further polymer concrete layer on top of the tubes; a fiberglass sheet 16 is laid on top of the poured polymer concrete; and a final layer of polymer concrete is poured on top of fiberglass sheet 16 to complete the block. The mold is now vibrated to insure that the polymer concrete totally fills tubes 14 and to impart a stippled surface texture to all of the outer surfaces of the block. After a cure time ranging from 20 minutes to several hours, the block may be removed from the mold and is ready for use.

The invention blocks are seen in a typical application in FIG. 1 in which a plurality of blocks 10 are arranged end to end and side by side to form a flooring over parallel, widely spaced structural beams 20. There are many applications in industry where blocks or slabs capable of spanning widely spaced structural beams are required. For example, in the automotive industry, flooring is often required at various levels around large vertical presses such as stamping presses. Prior art concrete and polymer concrete blocks or slabs are totally unsuitable for this application since their bending strength is severly limited.

Invention blocks having the described general dimensions have been professionally tested with the block spanning structural beams on 30 inch centers with a unsupported span between the beams of 23 inches. With a 5 inch wide test beam placed across the center axis of the block and an ever increasing load applied on the test beam, the test block was loaded to a load of 62,500 lbs. In this test, the invention block sustained a deflection of less than ½ inch at its center point and showed no evidence of failure. Concrete blocks of similar size, and polymer concrete blocks of similar size but without the invention reinforcing construction, have totally failed this test at loading magnitudes that are small fractions of the load at which the invention block remain totally intact with minimal deflection.

Whereas a preferred embodiment of the invention has been illustrated and described in detail, it will be apparent that various changes may be made in the disclosed embodiment without departing from the scope or spirit of the invention.

We claim:

1. A block especially suited for use an an unsupported floor slab, said block comprising:

(A) a monolithic rectangular parallelipipid matrix formed of polymer concrete and having parallel, flat upper and lower surfaces, end edge surfaces, and side edge surfaces;

(B) a row of steel tubes embedded in said polymer matrix with (1) said polymer concrete totally filling said tubes, (2) said tubes extending in side by side spaced parallel fashion substantially from end to end of said matrix and generally parallel to said side edge surfaces of said matrix, (3) said row of tubes extending substantially totally across said matrix from a location adjacent one side edge surface to a location adjacent the other side edge surface, (4) the upper surface of said tubes spaced below said upper surface of said matrix, and (5) the lower surface of said tubes spaced above said lower surface of said matrix;

(C) a first sheet of fabric embedded in said matrix between, and spaced respectively from, the upper surfaces of said tubes and said upper surface of said matrix; and (D) a second sheet of fabric embedded in said matrix between, and spaced respectively from, the lower surfaces of said tubes and said lower surface of said matrix.

2. A block according to claim 1 wherein:

E. said fabric sheets comprise sheets of woven fiberglass.

3. A block according to claim 1 wherein:

E. said tubes extend in the direction of the length of said block and are spaced across the width of said block; and F. said block has a thickness substantially less than its length and width.

4. A block according to claim 3 wherein:

G. said tubes have a rectangular cross section and are arranged in said matrix with their upper and lower surfaces lying in common planes respectively parallel to the upper and lower surfaces of said matrix.

5. A block according to claim 4 wherein:

H. said tubes have a width greater than their thickness and are arranged with their widths extending parallel to said upper and lower surfaces of said matrix.

6. A block according to claim 5 wherein:

I. the sum of the widths of said tubes is more than half of the width of said matrix.

7. A block according to claim 6 wherein:

J. said block has a length greater than its width

8. A block according to claim 6 wherein:

J. said tubes have a thickness less than one half but more than one third the thickness of said matrix.

9. A block according to claim 8 wherein:

K. said first and second sheets of fabric comprise first and second sheets of woven fiberglass; and L. said first and second sheets of woven fiberglass are respectively disposed substantially midway between said upper and lower surfaces of said tubes and said upper and lower surfaces of said matrix.

* * * * *